United States Patent [19]

Lehinant et al.

[11] 4,277,246

[45] Jul. 7, 1981

[54] PROCESS FOR THE DYEING OF CELLULOSE FIBERS WITH REACTIVE DYES ACCORDING TO THE BATCHWISE EXHAUSTION METHOD

[75] Inventors: Armand Lehinant, Offenbach am Main; Joachim W. Lehmann, Kelkheim; Hans-Peter Maier, Sulzbach, all of Fed. Rep. of Germany

[73] Assignee: Hoechst Aktiengesellschaft, Frankfurt am Main, Fed. Rep. of Germany

[21] Appl. No.: 163,202

[22] Filed: Jun. 25, 1980

Related U.S. Application Data

[63] Continuation of Ser. No. 64,778, Aug. 8, 1979, abandoned.

[30] Foreign Application Priority Data

Aug. 10, 1978 [DE] Fed. Rep. of Germany ..... 2835035

[51] Int. Cl.[3] ..... D06P 3/66

[52] U.S. Cl. ..... 8/532; 8/543; 8/618; 8/918

[58] Field of Search ..... 8/532, 543, 618, 981

[56] References Cited

U.S. PATENT DOCUMENTS

| | | | |
|---|---|---|---|
| 3,767,356 | 10/1973 | Turner . | |
| 3,791,787 | 2/1974 | Yamada et al. | 8/576 |
| 4,078,885 | 3/1978 | Opitz et al. . | |

FOREIGN PATENT DOCUMENTS 2340043 3/1975 Fed. Rep. of Germany .

*Primary Examiner*—A. Lionel Clingman
*Attorney, Agent, or Firm*—Curtis, Morris & Safford

[57] ABSTRACT

A process for the dyeing of textiles which consist totally or partially of cellulose fibers, with reactive dyes according to the batchwise exhaustion method, which comprises using aqueous dye liquors containing one or several reactive dyes as well as at least one neutral electrolyte, the initial pH values of said liquors being in the slightly acid range, in the high temperature range at 110° to 140° C. without the addition of an alkali or alkali-yielding agents.

6 Claims, No Drawings

PROCESS FOR THE DYEING OF CELLULOSE FIBERS WITH REACTIVE DYES ACCORDING TO THE BATCHWISE EXHAUSTION METHOD

This is a continuation of application Ser. No. 064,778, filed Aug. 8, 1979, now abandoned.

The present invention relates to a process for the dyeing of cellulose fibers with reactive dyes according to the batchwise exhaustion method.

The present invention provides a process for the dyeing of textiles made of cellulose fibers and/or of the cellulose fiber portion of mixtures of cellulose fibers with polyester fibers with reactive dyes according to the batchwise exhaustion method. In the case of fiber mixtures of this kind the mode of operation according to the invention is especially important for the one-bath dyeing process with combinations of reactive and disperse dyes.

From German Pat. Specification No. 1,619,464 a process is known, according to which mixtures of cellulose and polyester fibers are dyed with reactive and disperse dyes according to the batchwise exhaustion method in the one-bath process at elevated temperatures. In this case the aqueous dye liquors used contain, besides the said dyestuffs, and alkalis, additionally halogen-containing organic compounds acting as acid-yielding agents in the heat. In the alkaline medium which is initially present, the reactive dye is at first fixed on the cellulose fiber portion of the dyeing goods at the low temperatures of the heating phase of the liquor; in the further course of the dyeing process the alkali which adversely affects the chemical stability of the disperse dye is consumed by the acid-yielding agent, and thereafter the polyester fiber portion is dyed in a second stage with the disperse dye under the acid conditions having been established, at a temperature of more than 100° C.

As may be seen from the experimental examples of this state of the art, the dyeing period is 1½ hours altogether; the expenditure of reactive dye is unsuitably high (for example 5%), relative to the portion of the cotton component of the textile goods and to the color depth of the polyester fiber portion; besides, additions of alkali and acid-yielding agents are required. Since the disperse dye which is sensitive to alkali is exposed in the common bath to the influence of the alkali present during the dyeing up to the neutralization by the acid-yielding agent, said dyestuff may easily be damaged with regard to its shade and its fastness properties and dyestuff yield.

It has therefore been the underlying objective of the present invention to dye cellulose fibers by a special dyeing process in a substantially shortened and highly simplified operation with good fastness properties. Within the framework of conventional one-bath processes for the dyeing of, preferably, mixtures of cellulose fibers and polyester fibers, while using reactive dyes, it has not only been a desirable object—as compared with the relevant state of the art—to obtain a substantial reduction of the total dyeing period, but also to simplify the measures required in order to carry out such dyeings, without having to face an impaired fixation due to the influence of alkali of a disperse dye possibly present at the same time due.

This task is solved according to the invention by using aqueous dye liquors containing one or several reactive dyes as well as at least one neutral electrolyte, the initial pH values of said dye liquors being in the slightly acid range, and by effecting the dyeing with these liquors in the high temperature range at a temperature of from 100° to 140° C. without the addition of an alkali or alkali-yielding agent.

As the reactive dye is very rapidly absorbed by the cellulose fibers under these conditions, a considerable reduction of the dyeing period may be obtained. The reactive dyes are fixed on the fiber within a period of from 5 to 30 minutes, preferably from 10 to 20 minutes, while the yield remains constant as compared with a conventional batchwise exhaustion process with alkali at a temperature of up to about 80° C.

With regard to the fact that the processes common so far for the dyeing of cellulose fibers with reactive dyes have been carried out using alkalis or alkali-yielding agents in all variants for the fixation of these dyestuffs, it was surprising that under the high temperature conditions according to the invention cellulose fibers may be dyed with reactive dyes without the addition of alkalis or alkali-yielding agents. It is to be assumed that besides the normal reaction between the dyestuff and the cellulose fiber there is a development different from that of the conventional alkaline fixation processes, although the same result of a covalent binding of the dyestuff to the cellulose fiber with the corresponding fastness properties is attained.

The process of the invention may preferably be considered for the one-bath dyeing of mixtures of cellulose and polyester fibers, in which operation the advantages of the novel application technique for the reactive dyes become particularly evident. In this case the dye liquors being used contain additionally disperse dyes; however, the use of acid-yielding agents is not required. The measures of the invention for the dyeing of said fiber mixtures may be carried out in a one-stage as well as in a two-stage operation. In accordance with the last-mentioned principle, the reactive dye may alternatively be introduced into the high temperature apparatus following a preliminary dyeing period for the polyester fiber portion, for example in rapid dyeing processes.

When carrying out the process of the invention, the two dyestuff components present in the case of fiber mixtures are predispersed and/or dissolved in common manner and are added to the liquors together with the amount of neutral electrolyte common for batchwise exhaustion processes. The pH values of these liquors (measured at 20° C.) should be in the slightly acid range; a pH adjustment is not required in most cases, as aqueous solutions of reactive dyes (in a commercial form and quality) are slightly acid per se. By slightly acid pH conditions there is to be understood generally a range of from 4.0 to 6.8, preferably from 5.5 to 6.5. Process waters which have been softened with cation exchangers are frequently slightly alkaline and therefore require a pH correction to the above-mentioned range. In some cases the simultaneous use of products protecting the dyestuff from reduction, for example those based on m-nitrobenzene sulfonates, may be advantageous.

If fiber mixtures are present, the liquor and the dyeing goods are heated to the dyeing temperature—depending on the intended process—and the dyeing is carried out at a temperature of from 110° to 140° C., preferably from 120° to 130° C., for a period of 30 to 90 minutes, or a liquor which contains only the disperse dye is at first made to act on the goods at dyeing temperature for a corresponding period, and 5 to 15 minutes before the end of the dyeing period the solution of the reactive dye is introduced into the high temperature container. After 15 minutes of dyeing at 120° C., for example, the reactive dye is fixed according to this variant on the cellulose fiber portion of the goods. At the higher temperatures, the dyeing period for the reactive dye may be reduced, for example at 130° C. to 5 to 10 minutes.

The after-treatment of the dyeings produced in accordance with the invention depends on the dyestuffs employed. Generally it may be simplified to a high degree. In many cases the goods need only to be rinsed with water of a temperature of from 60° to 70° C. and with cold water.

For the dyeing of cellulose fibers and/or of the cellulose fiber portion of fiber mixtures according to the present invention the reactive dyes considered are the organic dyestuffs known by this term, independently of the nature of their reactive groups. This class of dyestuffs is termed "Reactive Dyes" in Colour Index, 3rd edition, 1971. However, preference is given to those dyestuffs which have a high affinity to the cellulose fiber. In many cases there is more than one sulfonic acid group (besides the reactive component of the dyestuff) in the molecule; dyestuffs of this kind show very good yields (as compared with the color depths which may be obtained with conventional batchwise exhaustion processes).

The dyestuffs concerned are predominantly those dyestuffs which contain at least one group which is able to react with polyhydroxyl fibers, a precursor of the same, or a substituent that can be reacted with the polyhydroxyl fiber. As basic substances of the organic dyestuffs there are especially suitable those of the series of azo, anthraquinone and phthalocyanine dyestuffs, the azo and phthalocyanine dyestuffs optionally being free from metal or containing metal. As reactive groups and precursors forming these reactive groups there may be mentioned, for example, epoxy groups, the ethylene imide group, the vinyl grouping in the vinylsulfone or acrylic acid radicals, moreover, the β-sulfatoethylsulfone group, the β-chloroethylsulfone group or the β-dialkylaminoethylsulfone group. Besides, there may be mentioned for this process derivatives of the tetrafluorocyclobutyl series, for example tetrafluorocyclobutylacrylic acid. As reactive substituents in reactive dyes there may be used those which can easily be split off and leave an electrophilic radical. As substituents there may be mentioned, for example, from 1 to 3 halogen atoms at the following ring systems: Quinoxaline, triazine, pyrimidine, phthalazine, pyridazine and pyridazone. Use may also be made of dyestuffs having several homogeneous or heterogeneous reactive groups.

As disperse dyestuffs for the dyeing of the polyester fiber component there are suitable all water-insoluble dyestuffs which are specified in Colour Index, 3rd edition, 1971, under the term of "Disperse Dyes". Products of this kind originate, for example, from the series of azo, anthraquinone or quinophthalone dyestuffs, the azo dyestuffs optionally being employed in a metal-containing form as well as in a metal-free form. Dyestuffs of the above-mentioned category have been sufficiently known.

Examples for neutral electrolytes which may be used are sodium chloride and sodium sulfate.

In German Auslegeschrift No. 21 58 314 the one-bath dyeing of cellulose/polyester fiber mixed textiles has been described, according to which the textile material is treated with a dye liquor containing a mixture of a disperse dyestuff and a specially selected reactive dye at a pH value of from 5.0 to 5.5 and at a temperature of from 100° to 140° C., until the polyester fiber component has been dyed with the disperse dye. Thereafter the dye bath is cooled to 80° C., the liquor is rendered alkaline, and the dyeing is continued at 80° to 90° C. and at a pH value of more than 8.0, until the cellulose fiber component has been dyed with the reactive dye. Although in the first stage of this state of the art the conditions correspond to those of the present invention, an addition of alkalis for the fixation of the reactive dyes is considered necessary according to the known process. It is therefore to be stated that said publication in no way puts forth a technical teaching which merely recommends the application of high temperature conditions without any addition of alkali, in order to fix reactive dyes in the batchwise exhaustion process.

The following Examples serve to illustrate the invention.

EXAMPLE 1

In a high temperature dyeing apparatus, cross-wound bobbins of mercerized wetted-out cotton yarns are dyed, at a goods-to-liquor ratio of 1:20, with a liquor containing an aqueous solution of 3% (of the weight of the dry yarns) of the reactive dye of the formula

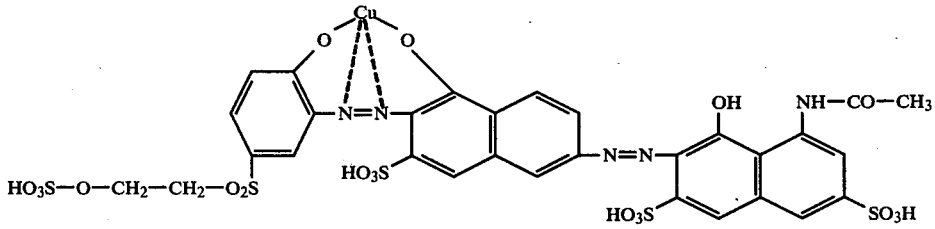

(in a commercial form and quality) and 50 g/l of common salt. The pH value of the liquor thus prepared is 5.6 and does not require any correction.

The dyeing goods are introduced into the bath at 40° C., then the liquor is rapidly heated to the dyeing temperature of 120° C., and the goods are dyed for 15 minutes at 120° C. Thereafter the bath is cooled, and the dyeing produced is rinsed with hot and cold water and adjusted to a neutral pH value.

There results a navy blue dyeing whose depth corresponds to the dyestuff expenditure in the case of conventional batchwise exhaustion processes.

EXAMPLE 2

On a high temperature beam dyeing apparatus a mixed fabric of polyester fibers and cotton (67/33) is treated, at a goods-to-liquor ratio of 1:20, with an aqueous liquor which contains, calculated on the weight of the dry goods, 1.5% of the disperse dye of the formula

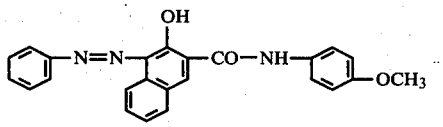

and 60 g/l of common salt. The fiber mixture is dyed with this liquor at first for 45 minutes at 130° C., and then an aqueous solution of 1.5% of the reactive dye of the formula

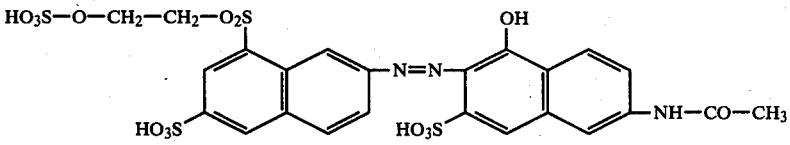

(in a commercial form and quality), calculated on the weight of the dry goods, whose starting pH value is 6.2, is introduced into the circulating bath, and the textile goods are dyed for another 10 minutes under these conditions. The further treatment of the dyeing thus produced is effected by rinsing and soaping in common manner.

There results a bright orange dyeing on both fiber portions.

EXAMPLE 3

On a high temperature beam dyeing apparatus, a material of 67% of polyester fibers and 33% of cotton is dyed, at a goods-to-liquor ratio of 1:20, with an aqueous liquor which contains—calculated on the weight of the dry goods:

1.5% of the disperse dye of the formula

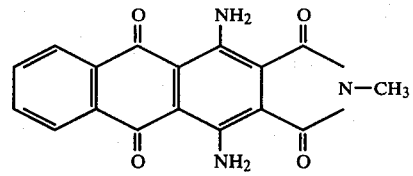

1.5% of the reactive dye of the formula

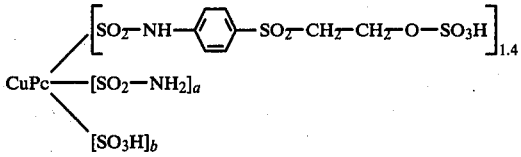

CuPc = copper phthalocyanine
a + b = 2.6

(the dyestuffs being present in a commercial form and quality)

and 60 g/l of common salt. The starting pH value of the dissolved reactive dye is 6.0.

The textile goods are dyed with this liquor for 50 minutes at 125° C., and a bright blue dyeing is obtained on both fiber portions.

FURTHER EXAMPLES

The process is carried out in accordance with the specifications given in Examples 1, 2 and 3, however, while using the reactive dyes mentioned below (in a commercial form and quality), and similarly favorable results are obtained. The process of the invention is not restricted, however, to these dyestuffs.

| EXAMPLE | Dyestuff of the formula | Shade on cellulose fibers |
|---|---|---|
| 4 | 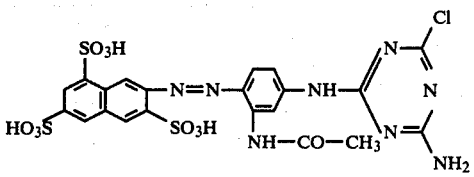 | yellow |
| 5 | 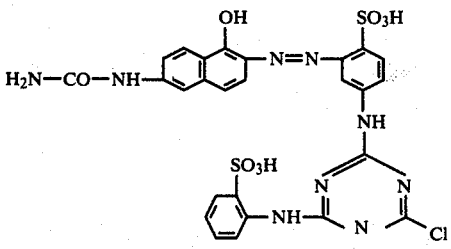 | orange |

-continued
| EXAMPLE | Dyestuff of the formula | Shade on cellulose fibers |
|---|---|---|
| 6 | 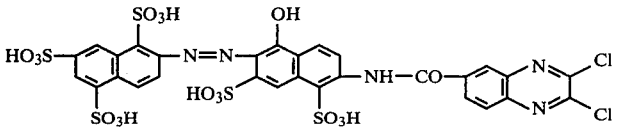 | orange |
| 7 | 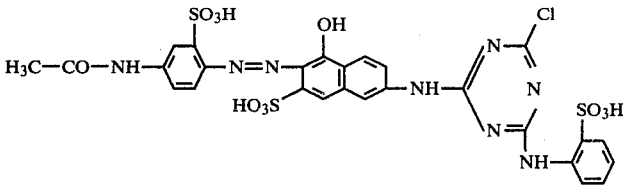 | scarlet |
| 8 | 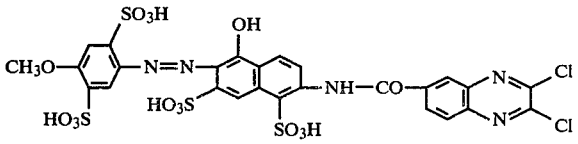 | scarlet |
| 9 | 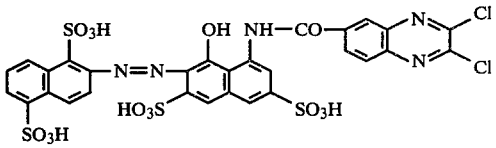 | red |
| 10 | 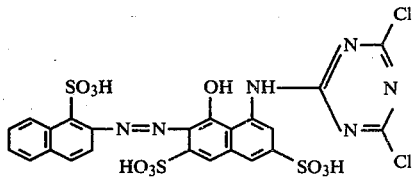 | red |
| 11 | 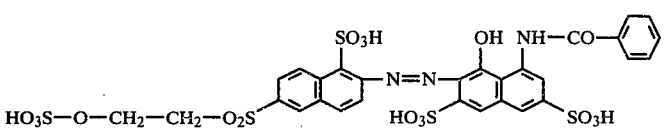 | red |
| 12 | 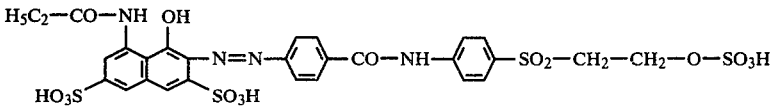 | red |
| 13 | 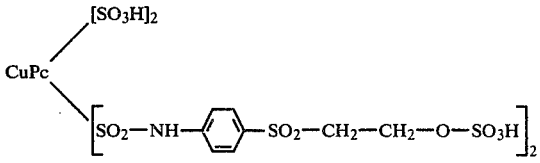 CuPc = copper phthalocyanine | turquoise |
| 14 | 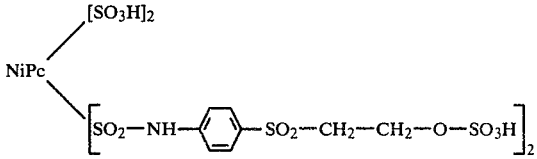 NiPc = nickel phthalocyanine | bluish green |
| 15 | 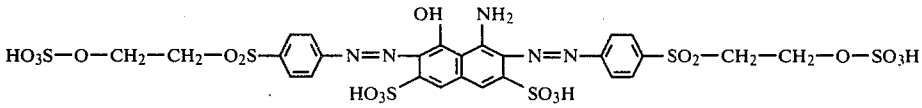 | dark blue |

-continued

| EXAMPLE | Dyestuff of the formula | Shade on cellulose fibers |
|---|---|---|
| 16 | 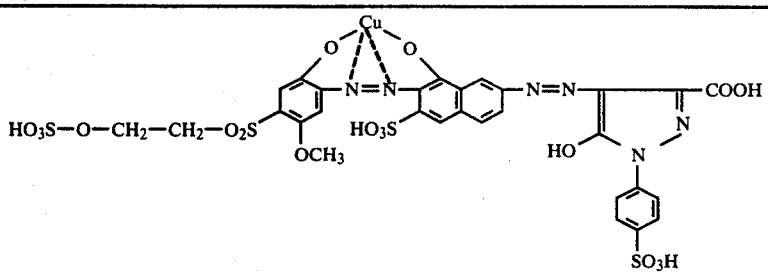 | anthracite |
| 17 | 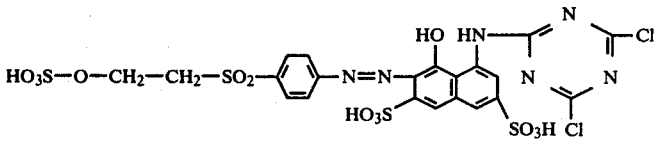 | red |

EXAMPLE 18

A navy blue dyeing as in Example 1 may also be prepared on a polyester/cotton mixed fabric, if the dyeing operation is carried out according to the prescription given therein and if an aqueous liquor is used which contains, calculated on the weight of the dry goods, 1.8% of the dyestuff Disperse Blue 56 with the C.I. No. 63 285, 0.5% of the dyestuff Disperse Brown 1 with the C.I. No. 11 152, 0.5% of the disperse dye of the formula

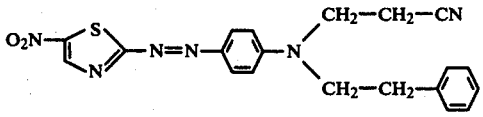

1.8% of the reactive dye of the formula

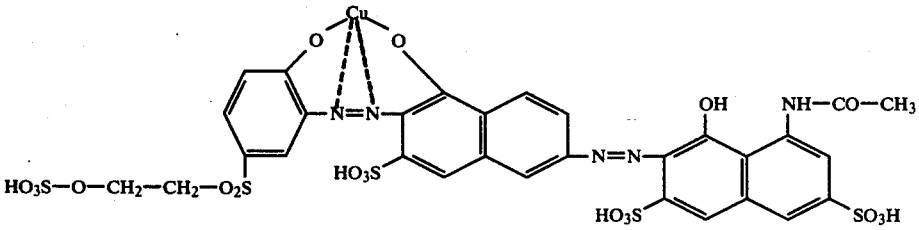

0.4% of the reactive dye of the formula

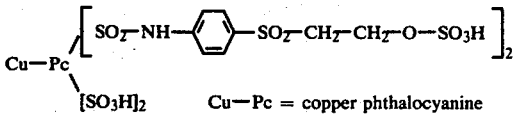

(the dyestuffs being present in a commercial form and quality), as well as 60 g/l of Glauber's salt.

What is claimed is:

1. In a process for the dyeing of a textile consisting of or containing cellulose fibers, with one or more reactive dyes according to the batchwise exhaustion method, the improvement which comprises dyeing with an aqueous dye liquor containing one or more reactive dyes and at least one neutral electrolyte, the initial pH value of said dye liquor being in the slightly acid range, at a temperature in the range of from 110° to 140° C., without the addition of an alkali or alkali-yielding agent.

2. A process as defined in claim 1, which comprises dyeing a mixture of cellulose and polyester fibers in a two-stage, one-bath operation, the dye liquor additionally containing one or more disperse dyes, but not containing an acid-yielding agent.

3. A process as defined in claim 1, which comprises dyeing a mixture of cellulose and polyester fibers in a one-stage, one-bath operation, the dye liquor additionally containing one or more disperse dyes, but not containing an acid-yielding agent.

4. A process as defined in claim 1, 2 or 3, which comprises contacting the textile with the dye liquor for a time of from 5 to 30 minutes.

5. A process as defined in claim 1, 2 or 3, which further comprises aftertreating of the dyed textile, following the dyeing operation, without the addition of an alkali or alkali-yielding agent and without the addition of an acid or acid-yielding agent.

6. In a process for the dyeing of a textile consisting of or containing cellulose fibers, with one or more reactive dyes according to the batchwise exhaustion method, the improvement which consists essentially of dyeing with an aqueous dye liquor containing one or more reactive dyes and at least one neutral electrolyte, the initial pH value of said dye liquor being in the slightly acid range, at a temperature in the range of from 110° to 140° C., without the addition of an alkali or alkali-yielding agent.

* * * * *